US007117693B1

(12) United States Patent
Nova

(10) Patent No.: US 7,117,693 B1
(45) Date of Patent: Oct. 10, 2006

(54) CIRCULAR KNITTING NEEDLE ASSEMBLY

(76) Inventor: Amana Nova, 412 N. Coast Hwy., #114, Laguna Beach, CA (US) 92651

( * ) Notice: Subject to any disclaimer, the term of this patent is extended or adjusted under 35 U.S.C. 154(b) by 0 days.

(21) Appl. No.: 11/410,623

(22) Filed: Apr. 25, 2006

Related U.S. Application Data

(60) Provisional application No. 60/674,000, filed on Apr. 25, 2005.

(51) Int. Cl.
*D04B 35/02* (2006.01)

(52) U.S. Cl. ..... 66/117

(58) Field of Classification Search ..... 66/117, 66/1 A, 116, 118
See application file for complete search history.

(56) References Cited

U.S. PATENT DOCUMENTS 1,948,844 A * 2/1934 Dawes ..... 87/2
1,966,690 A * 7/1934 Bergen ..... 66/117
2,045,267 A * 6/1936 Grahman ..... 66/117
2,093,631 A * 9/1937 Burnham ..... 66/117
2,094,262 A * 9/1937 Burnham ..... 66/117
2,230,495 A * 2/1941 Kohlmann ..... 66/117
2,462,473 A * 2/1949 Delaney ..... 66/117
2,507,174 A 5/1950 Phillips
3,486,409 A * 12/1969 Powell ..... 87/6
4,553,410 A 11/1985 Okada
5,720,187 A 2/1998 Matuo
6,397,640 B1 6/2002 Williams
6,983,627 B1 * 1/2006 Eley-Holden-Sotnik ..... 66/117

* cited by examiner

*Primary Examiner*—Danny Worrell
(74) *Attorney, Agent, or Firm*—Harpman & Harpman

(57) ABSTRACT

A knitting needle assembly for knitting tubular configurations having pairs of oppositely disposed rigid knitting needles interconnected by a flexible member of similar trans-dimensional properties.

7 Claims, 2 Drawing Sheets

CIRCULAR KNITTING NEEDLE ASSEMBLY

This application claims the benefit of U.S. Provisional Application No. 60/674,000, filed Apr. 25, 2005.

BACKGROUND OF THE INVENTION

1. Technical Field

This device relates to knitting needles which are typically elongated cylindrical elements with a pointed and opposing blunt ends used in the process of hand knitting in which yarn is manipulated in interlocking patterns to form integral panels of configured material that can be fashioned into clothing, for example.

2. Description of Prior Art

Prior art devices disclose a variety of knitting needle combinations; see for example U.S. Pat. Nos. 2,507,174, 4,553,410, 5,720,187 and 6,397,640.

In U.S. Pat. No. 2,507,174 a bend type knitting needle is shown having a pair of curved needles interconnected by multiple linked flexible connector.

U.S. Pat. No. 4,553,410 claims knitting needles with a flexible cord interconnect. The needles are of a larger diameter than the cord with a transition connection therebetween.

U.S. Pat. No. 5,720,187 discloses a knitting needle pair with an interconnected small diameter flexible cord therebetween.

U.S. Pat. No. 6,397,640 discloses a pair of knitting needles with elongated channels within from which extend interlinking cord extends.

SUMMARY OF THE INVENTION

A circular knitting needle assembly in which a pair of short, straight needle elements are secured to the oppositely disposed free ends of a flexible cord covered with a resilient synthetic fiber fabric defining a smooth continuous surface of a low frictional co-efficient. The flexible interconnection cord is of an equal diameter to that of the respective needles with an equilateral transition there between.

DETAILED DESCRIPTION OF THE INVENTION

Figure 1:
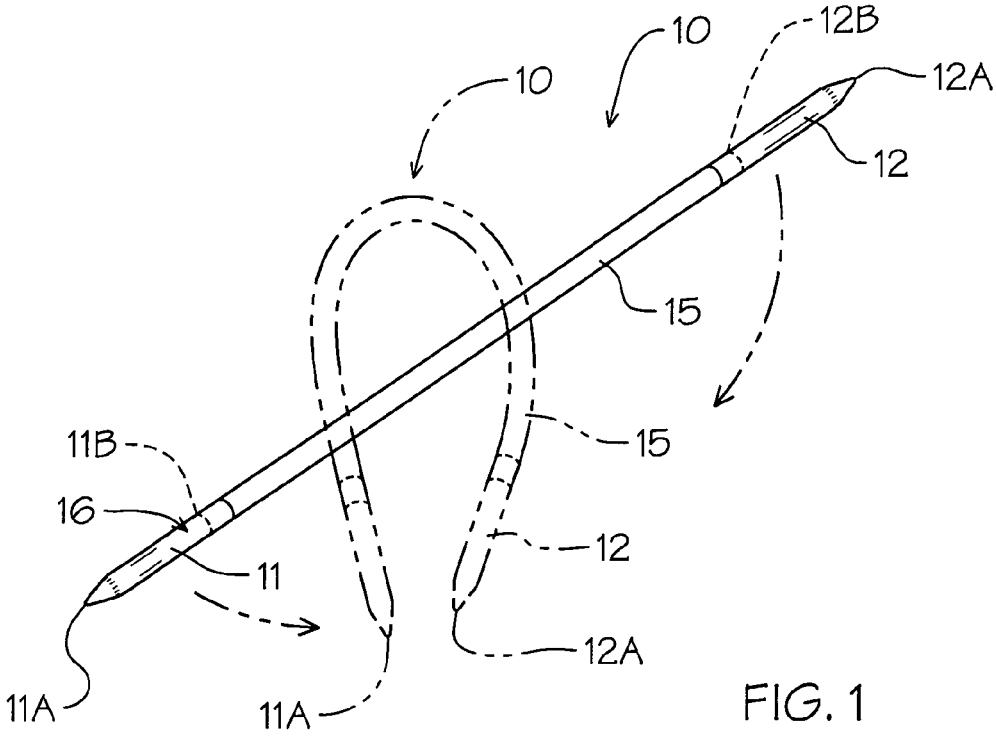
FIG. 1 is a perspective view of the knitting needle assembly shown in both solid and broken lines.
Figure 3:
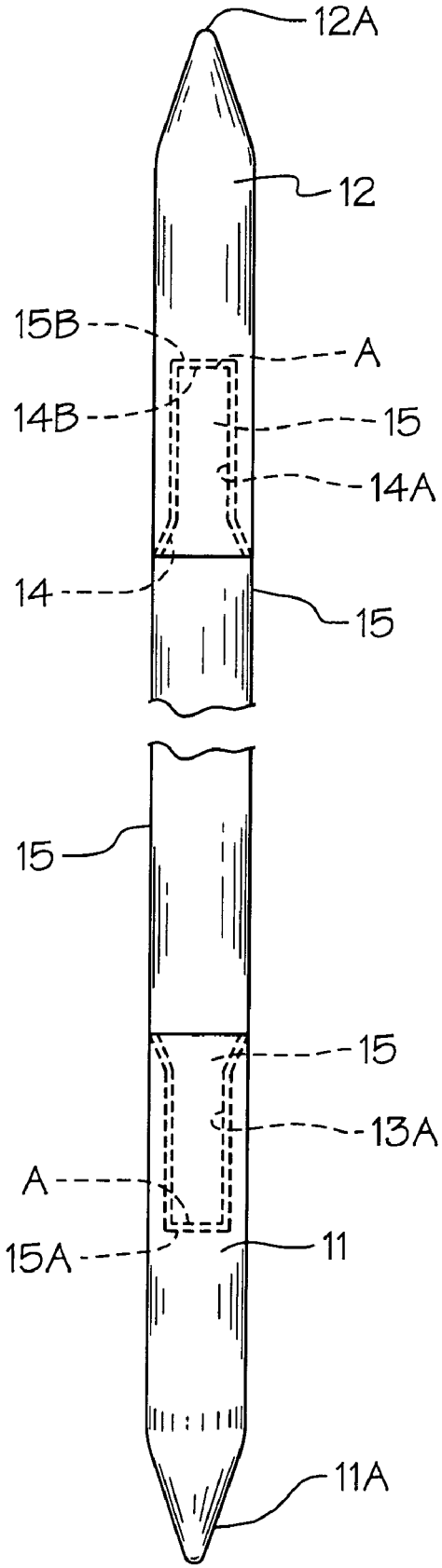
FIG. 3 is an enlarged side elevational view of the knitting needle assembly with portions broken away.

A circular knitting needle assembly 10 can be seen in FIGS. 1 and 3 of the drawings having a pair of rigid preferably molded needle elements 11 and 12 having respective conical free ends 11A and 12A and opposing inner attachment distal ends 11B and 12B. The needle elements 11 and 12 are identical which are gripped by the knitter (not shown) during use and used together with yarn (not shown) to perform a singular task well known to those skilled in the art as knitting.

Figure 2:
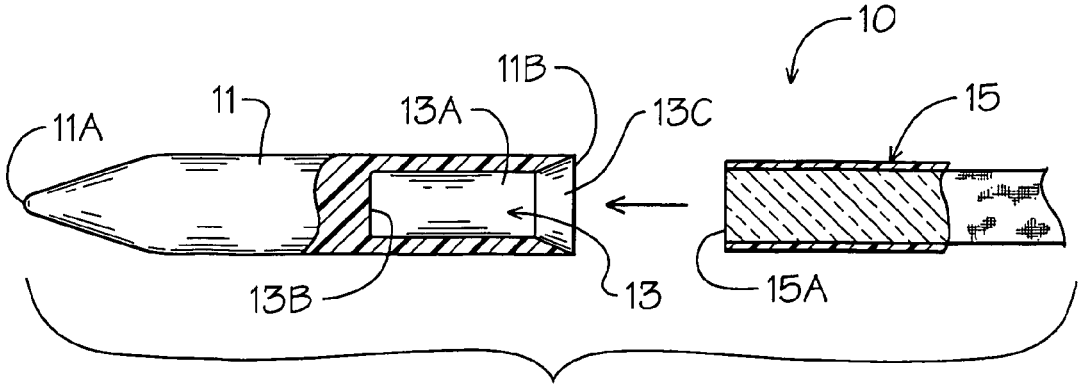
FIG. 2 is an elongated partial cross-sectional view of an end portion of the assembly with elements broken away for illustration.

Each of the needle elements 11 and 12 have respective bore openings 13 and 14 formed centrally therein inwardly from their respective distal inner attachment ends 11B and 12B as best seen in FIG. 2 of the drawings. The bores 13 and 14 have continuous respective internal sidewalls 13A and 14A with a terminal annular end wall surface 13B and 14B. The sidewalls 13A and 14A have respective tapered end surface positioned at 13C and 14C.

A length of flexible resilient elongated cylindrical fabric cord 15 is provided and is covered with a resilient flexible synthetic fabric base material 15A, such as or similar to Lycra brand having a tight fabric weave to define a smooth low friction contiguous outer surface. The so-configured covered cord 15 having oppositely disposed ends 15A and 15B is receivably secured within their respective bores 13 and 14 interconnecting the needle elements 11 and 12 together as best seen in FIG. 1 of the drawings. The covered cord 15 being of an annular dimension equal to that of the needle elements with the respective cord ends 15A and 15B secured within the respective bores 13 and 14 indicated by directional arrow in FIG. 2 of the drawings.

It will be noted that the respective tapered end opening portions at 13C and 14C and the sidewalls 13A and 14A assist in the insertion process of the cord ends 15A and 15B that compress during assembly.

Figure 4:
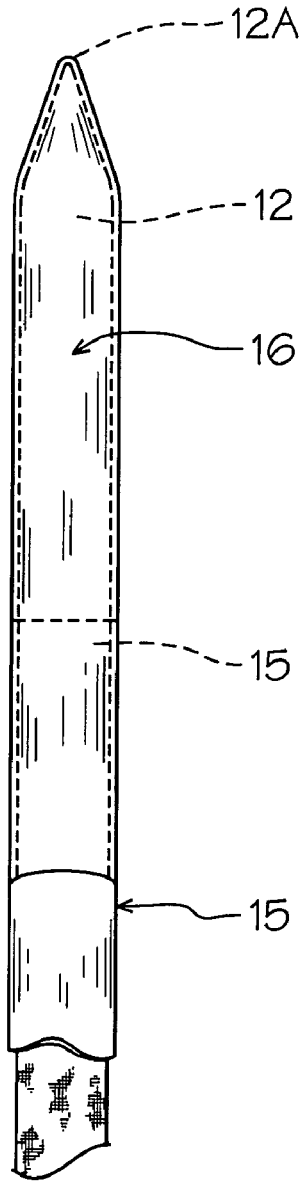
FIG. 4 is an enlarged side elevational view of one end portion of the assembly completed for use.

Referring now to FIG. 4 of the drawings, the respective cords ends 15A and 15B are secured within their respective receiving knitting needle element bores 13 and 14 by inclusion of epoxy adhesive A within the respective bores during insertion.

Once completed, the interconnected needle elements 11 and 12 and covered cord 15 impart a continuous smooth surface which aids in the functionality of the needled assembly 10 by providing an integrated low friction surface. This covered cord 15 also provides a smooth protective transition between the distal needle ends 11B and 12B and the cord 15 as best seen at 16A in dotted lines.

It will be evident that a variety of materials, natural and/or synthetic, may be used to form the needle elements 11 and 12 and it will also be evident from the above description that the interengaging covered cord 15 is preferably made of a fiber configuration or equivalent construction and materials well known within the art.

In this example chosen for illustration, a proportional length of the needle elements 11 and 12 to the interconnecting covered cord 15 are of a ratio of four to one, but be other ratios depending on the properties of the cord 15 material so chosen and the required use venues.

It will thus be seen that a new and novel knitting needle assembly 10 has been illustrated and described and it will be apparent to those skilled in the art that various changes and modifications may be made thereto without departing from the spirit of the invention.

Therefore I claim:

1. A flexible knitting needle assembly comprising, a pair of rigid needle elements, each having conical work engagement ends and a cord engagement end in oppositely disposed relation thereto, a flexible cord interengaged between said respective cord engagement ends interconnecting said needle elements to one another, said cord comprising multiple interwoven fabric filaments covered with a resilient smooth cylindrical sleeve thereabout, means for securing said cord within said corresponding cord engagement ends by adhesively bonding together, said covered cord being of a known cylindrical dimension equal to that of said needle elements, said smooth cylindrical sleeve formed from a synthetic fabric material with a corresponding low frictional co-efficient.

2. The flexible knitting needle assembly set forth in claim 1 wherein said means for securing said respective end cords within said corresponding aligned cord engagement ends comprises, a cord receptacle bore extending inwardly from said respective cord engagement ends of said needle elements.

3. The flexible knitting needle assembly set forth in claim 1 wherein said cylindrical sleeve thereabout said respective cord engagement ends of said cord and said abutting annular surface engagement ends of said respective needle elements provide for a flush inter-relationship therebetween.

4. The flexible knitting needle assembly set forth in claim 3 wherein said flush inter-relationship between said corresponding respective cord engagement ends of said cord and said abutting annular surface engagement ends of said respective needle elements define an annular co-planar surface therebetween.

5. The flexible knitting needle assembly set forth in claim 1 wherein said needle elements are of a known length equal to one another and less than that of said interconnected cord interengaging therebetween for repositioning access engagement with one another.

6. The flexible knitting needle assembly set forth in claim 1 wherein said needle elements are preferably made from synthetic resin based moldable material.

7. The flexible knitting needle assembly set forth in claim 1 wherein said resilient smooth cylindrical sleeve defines a yieldable displaceable outer surface on said cord resistant to frictional engagement.

* * * * *